US006284099B1

(12) United States Patent
Peutherer et al.

(10) Patent No.: US 6,284,099 B1
(45) Date of Patent: Sep. 4, 2001

(54) SIZING OF PAPER

(75) Inventors: Peter Peutherer, Huddersfield; Ian Mark Waring, Bolton; Lesley Collett, Barnsley, all of (GB)

(73) Assignee: Ciba Specialty Chemicals Water Treatments Limited, Bradford (GB)

( * ) Notice: Subject to any disclaimer, the term of this patent is extended or adjusted under 35 U.S.C. 154(b) by 0 days.

(21) Appl. No.: 09/125,624

(22) PCT Filed: Feb. 24, 1997

(86) PCT No.: PCT/GB97/00512

§ 371 Date: Aug. 21, 1998

§ 102(e) Date: Aug. 21, 1998

(87) PCT Pub. No.: WO97/31152

PCT Pub. Date: Aug. 28, 1997

(30) Foreign Application Priority Data

Feb. 23, 1996 (GB) ..... 9603909

(51) Int. Cl.[7] ..... D21H 17/69; D21H 17/15

(52) U.S. Cl. ..... 162/158; 162/179; 162/181.1; 162/181.6; 162/181.8; 106/266; 106/287.24; 106/486; 106/491

(58) Field of Search ..... 162/158, 179, 162/181.1, 181.6, 181.8, 183; 106/266, 287.24, 491, 486

(56) References Cited

U.S. PATENT DOCUMENTS

| | | | | |
|---|---|---|---|---|
| 2,992,964 | * | 7/1961 | Werner et al. | 162/158 |
| 4,214,948 | * | 7/1980 | Mazzarella et al. | 162/158 |
| 4,388,150 | | 6/1983 | Sunden et al. | 162/175 |
| 4,849,055 | | 7/1989 | Yoshioka et al. | 162/158 |
| 4,927,498 | | 5/1990 | Rushmere | 162/168.3 |
| 4,954,220 | | 9/1990 | Rushmere | 162/168.3 |
| 5,167,766 | | 12/1992 | Honig et al. | 162/164.1 |
| 5,176,891 | | 1/1993 | Rushmere | 423/328.1 |
| 5,274,055 | | 12/1993 | Honig et al. | 524/47 |
| 5,279,807 | | 1/1994 | Moffett et al. | 423/338 |
| 5,433,776 | | 7/1995 | Dasgupta | 106/287.2 |

FOREIGN PATENT DOCUMENTS

| | | |
|---|---|---|
| 202780 | 11/1985 | (EP) . |
| 235893 | 9/1987 | (EP) . |
| 308752 | 3/1989 | (EP) . |
| 335575 | 10/1989 | (EP) . |
| 418015 | 3/1991 | (EP) . |
| 499448 | 8/1992 | (EP) . |
| 608986 | 8/1994 | (EP) . |
| 95/21296 | 8/1995 | (WO) . |
| 96/17127 | 6/1996 | (WO) . |

* cited by examiner

*Primary Examiner*—Peter Chin
(74) *Attorney, Agent, or Firm*—David R. Crichton

(57) ABSTRACT

Sizing dispersions of liquid reactive size are made by dispersing the reactive size as a neat liquid into a dispersion of bentonite or other anionic microparticulate material in water. These dispersions can be used for internal sizing, for instance wherein the dispersion is used as the anionic microparticulate stage in a microparticulate retention papermaking process, or they can be used for external sizing.

24 Claims, No Drawings

SIZING OF PAPER

This invention relates to sizing compositions which can be used for the internal sizing of paper or the external sizing of paper, and relates especially to processes for making sized paper using these compositions.

Internally sized paper is generally made by incorporating an aqueous emulsion of the size into a cellulosic thin stock suspension, draining the suspension through a screen to form a sheet and then drying the sheet. Externally sized paper is generally made by coating a cellulosic sheet with an aqueous emulsion of the size, and drying the sheet. Often the external sizing operation is integrated with the production of the paper, so that a typical process comprises providing a cellulosic thin stock suspension, draining the thin stock suspension through a screen to form a sheet, drying the sheet, coating the dried sheet with the dispersion of size and then redrying the sheet.

Although non reactive sizes have traditionally been used, there are many instances where it is preferred to use a reactive size as part or all of the total size which is in or on the paper.

Since the reactive sizes are insoluble in water they have to be predispersed before use, i.e. before incorporation into the thin stock or before coating on to the sheet. The resultant dispersion (often referred to more accurately as an emulsion) has to be sufficiently stable that it does break before use. The formation of a stable emulsion of the size in water is normally achieved by emulsifying the size in the presence of emulsifying surfactant and/or cationic polyelectrolyte such as cationic starch. The use of cationic polyelectrolyte, and/or cationic emulsifying surfactant, has been considered advantageous as it is thought to promote the substantivity of the size on to the cellulosic fibres, especially when it is used for internal sizing. WO 97/31152 PCTIGB97/00512

When emulsifying surfactant is being used as the sole emulsifier, i.e., without cationic polyelectrolyte, it is normally necessary to use quite large amounts of the emulsifier in order to form a stable emulsion, typically up to 7 or 8% dry weight based on the weight of size. If cationic polyelectrolyte is included then lower amounts of the emulsifier may be sufficient, for instance down to 2%.

Even when the amount of emulsifying surfactant which is included to facilitate the formation of the emulsion is low, even this amount tends to detract from the sizing performance and so there have been many proposals to try to reduce the amount of emulsifying surfactant in the size. However if the amount is reduced too far, generally the resulting dispersion or emulsion is so unstable that adequate results are not obtained. Accordingly, despite efforts to the contrary, it is always necessary in conventional processes to use significant amounts of surfactant to promote the formation of a stable dispersion or emulsion.

It would be desirable to be able to produce sizing compositions which are adequately stable for use and which do not have the disadvantage of necessarily including significant amounts of emulsifying surfactant.

Sizing emulsions are usually made by homogenising the size into water, possibly using prolonged homogenisation. When the size is solid at room temperature (20° C.) it is common to conduct the homogenisation at an elevated temperature at which the size is molten. Because anhydride sizes tend to be unstable, it is generally necessary for the homogenisation and emulsification of anhydride sizes to be conducted at the mill. It would be desirable to be able to simplify the production of the sizing composition, and in particular to be able to reduce the amount of homogenisation that is required when the anhydride or other size is being emulsified for use at the mill.

Since anhydride sizes are, unfortunately, liable to undergo hydrolysis in water, the act of pre-emulsification and the handling the emulsion prior to use can result in some hydrolysis and formation of stickies originating from the size.

When the use of the emulsion involves introduction of the dispersion in the thin stock, the risk of stickies formation is undesirable because of the risk of contaminating the screen and because of the risk of contaminating the other components of the apparatus for handling the cellulosic suspension.

When the size emulsion is applied as an external size during the manufacture of the sheet, for instance at a size press, it is conventional to apply it warm (for instance above 40° C.) and to recycle excess emulsion. Thus the dispersed size is exposed to warm hydrolysis conditions for prolonged periods and stickies formation and other undesirable hydrolysis effects are particularly likely to occur. It is probably for this reason that anhydride sizes are normally considered unsuitable for application at the size press.

It would therefore be desirable to be able to put the anhydride or other size into a more stable form where there is less tendency for stickies formation to occur during the preparation and use of the emulsified size.

There is always a desire to improve the sizing performance which is obtained by internal or external sizing compositions. In some instances it is desirable to achieve this improvement in a general respect, for instance by obtaining an improved (i.e., lower) Cobb value. In other instances it is desirable to achieve improved sizing performance with respect to some particular usage. For instance externally sized paper may be used for ink jet printing wherein the black colour is a composite black which is generated by the ink jet printing, and it is then desirable to have a maximum optical density for this composite black. It would be desirable to be able to improve the sizing performance.

The manufacture of internally or externally sized paper necessarily involves a significant number of process steps and chemical additions, and it would be desirable to be able to combine two of these additions into a single addition which gives approximately equivalent performance or, preferably, better performance than is obtained when the additions are made separately.

Sizing compositions are usually cationic since it is conventional to assume that a cationic sizing composition will be more substantive to the paper substrate, especially when used as an internal size. Accordingly it is conventional to include cationic polyelectrolyte in the internal or other sizing composition. However, the use of anionic and non-ionic emulsifying surfactants, to give anionic or non-ionic dispersions or emulsions of the size, is known.

In EP-A-499,448 we describe a process utilising a microparticulate retention system wherein reactive size is added in the form of a non-ionic or anionic emulsion to the cellulosic suspension after flocculating the suspension by the addition of cationic retention aid. One preferred way of performing this process is by providing an emulsion of anhydride size or other size by emulsifying the size using anionic and/or non-ionic emulsifying surfactants and injecting this emulsion into the dispersion of bentonite or other microparticulate anionic material as that dispersion flows towards the point at which it is added to the cellulosic suspension. This process necessitates pre-emulsification of the size. It also suffers from the problem that emulsifying surfactant is necessarily introduced (with the consequential potential reduction in sizing performance) and there is opportunity for potential hydrolysis of the anhydride size with formation of sticky deposits.

Another disclosure of using an anionic dispersion of reactive size is in WO96/17127 (published after the priority date of this application). The anionic sizing dispersion is made by emulsifying a reactive size (preferably a ketene dimer size) in water to form a dispersion, and mixing this dispersion with a sol of colloidal anionic aluminium-modified silica particles. This technique therefore involves the conventional pre-emulsification of the size into water, followed by blending the emulsified size with the aluminium-modified silica sol. Apparently the unmodified silica sol does not provide useful stability in this process since it is stated that the aluminium modification improves stability. The resulting suspension was said, in one example, to be stable for a week. In the example, the suspension is added into the cellulosic thin stock followed by the addition of cationic starch. It is also mentioned elsewhere that the sizing dispersion can be added before, between, after or simultaneously with the addition of cationic polymers.

Anionic ketene dimer sizing compositions are also described in EP-A-418,015. They are made by emulsifying the ketene dimer size, while molten, into water in the presence of anionic dispersant or emulsifier. It is stated that the anionic charge density of the emulsified composition can be increased by the addition of anionic components such as anionic polyacrylamide, anionic starch or colloidal silica. The examples show that, in broad terms, internal sizing using the anionic compositions gives results (as measured by fluid pick up) about the same as or in some instances slightly worse than when cationic compositions are used. Further, the results show that increasing the anionic charge density does not improve performance but, instead, generally makes it worse. For instance the relevant liquid pick up of sheets sized with the anionic composition containing silica is shown to be much higher (worse) than the corresponding anionic composition free of silica (examples 11 and 13). Other data (for instance example 19) also shows worse results under some conditions.

It is also known from U.S. Pat. No. 5,433,776 to form an emulsion of ketene dimer with emulsifier and various cationic materials, including cationic colloidal silica. Again this involves the essential use of emulsifier, and again produces a cationic composition.

Many users consider anhydride sizes offer better performance than ketene dimer sizes, but the handling and hydrolysis difficulties are a disadvantage. It would be desirable to be able to reduce or eliminate these.

It would be desirable to be able to incorporate reactive size as an internal or external size with reduced need for the presence of emulsifying surfactant and therefore improved potential sizing properties. It would be desirable to be able to incorporate the reactive size, as an internal size, as part of another addition which is being made to the process, so as to minimise the number of addition points that are required. It would be desirable to be able to reduce the risk of hydrolysis, especially of anhydride sizes, and thereby reduce the risk of stickies contamination both during internal sizing and external sizing, especially when there is recycling of aqueous reactive size. It would be desirable to achieve these objectives using simple materials and simple mixing apparatus so that they can be achieved at the mill without additional complications in the paper making process.

According to the invention, we make a sizing composition of a reactive size which is liquid at room temperature by a process which comprises dispersing the reactive size as a neat liquid into a dispersion of anionic microparticulate material in water.

The resultant dispersion is a novel material and includes a sizing dispersion which is a dispersion in water of a reactive size (preferably ASA or other anhydride size) which is liquid at room temperature and anionic microparticulate material which stabilises the dispersion. Accordingly the dispersion can contain little or no emulsifying surfactant.

The invention also provides a process of sizing paper comprising providing the novel dispersion and/or forming a sizing dispersion by a method which comprises the defined process, and sizing the paper with the sizing dispersion.

The invention includes internal sizing processes wherein the paper is internally sized by incorporating the dispersion into a cellulosic thin stock suspension and then draining the suspension through a screen to form a sheet and drying the sheet.

The invention also includes external sizing processes which involve coating on to a paper sheet a sizing dispersion made by a process comprising a process as defined above.

As a result of forming the sizing dispersion in the presence of the anionic microparticulate material, it is possible to obtain a useful sizing dispersion using much less emulsifier than is required when the same size is dispersed in the same water in the absence of the anionic microparticulate material. Accordingly the invention allows for elimination or reduction of emulsifier, and thus permits improved sizing performance.

It is possible, by the invention, not only-to obtain improved physical stability but also improved chemical stability and thus it is possible to produce anhydride and other reactive size dispersions having less tendency to hydrolysis.

Since the dispersions of the invention contain two essential components (size and microparticulate material) each of which can give beneficial performance results in the paper making or paper coating process, the dispersions make it possible to obtain beneficial results using a single addition, whereas previously two separate additions would have been required.

A further advantage of the dispersions is that, despite the fact that they contain little or no emulsifier, they can generally be made using less homogenisation energy than is required when emulsifying the same size in the same water using a conventional emulsifier instead of the microparticulate material.

The sizing dispersion which is made and used in the invention must have sufficient stability that it is useful for sizing. Thus it should remain substantially homogeneous without significant separation or breakage for sufficient time to allow convenient handling of the dispersion between manufacture and use. Generally therefore it must be stable for at least about quarter of an hour and often it is appropriate to keep the dispersion for half an hour to two hours, or sometimes longer, prior to use, and so should then be stable throughout this period. Keeping the dispersion before use is often advantageous. However it is not essential for the dispersion to have long term (e.g., more than a week) storage stability and it is adequate for most purposes for it to be stable against separation or breakage for at least one hour and preferably at least five hours.

The reactive size which is used in the invention must be one which is liquid at room temperature, i.e., 20° C. Thus the conventional, high melting, ketene dimer sizes cannot be used and instead the size is a liquid ketene dimer size or, preferably, a liquid anhydride size.

The size therefore is preferably a liquid ketene dimer size such as oleyl ketene dimer size or any of the conventional anhydride sizes, since most or all of those are liquid at room temperature. The preferred anhydride size is alkenyl succinic anhydride (ASA) size.

The size may be supplied by the manufacturer either substantially pure or in combination with emulsifying surfactant. In the invention, the amount of surfactant required to make a stable dispersion, for use in the invention, can be much less than is required in normal processes. Accordingly it is possible, in the invention, to utilise sizes which are supplied with less than the normal amount of emulsifying surfactant and, preferably, to use sizes which are supplied with zero emulsifying surfactant. The amount, if any, of surfactant which needs to be added to optimise the formation of the dispersion can then be selected by the mill operator.

Although it is possible, in the invention, to include some surfactant in the dispersion, the presence of surfactant increases costs and causes technical problems, such as inferior sizing, and so usually the amount of surfactant is maintained at zero or as low as is practicable, consistent with obtaining an adequately stable dispersion.

In practice, the amount of surfactant which is incorporated in the dispersion is generally substantially less than is required to form a stable emulsion in the absence of the microparticulate material using that surfactant or surfactant blend. Generally the amount of surfactant is less than half the amount required to make a stable emulsion of that size in the same water in the absence of the microparticulate material. For instance if (as is common) it is necessary to include at least 5% (based on reactive size) by weight of a surfactant or surfactant blend in order to make a stable emulsion of that size in that water, then in the invention the amount of the surfactant should be less than 2%. Accordingly, if surfactant is present, the chosen surfactant and its amount is preferably such that a stable emulsion is not formed using that size in that water with 2 times, and preferably with 3 or 4 times, the amount of that surfactant.

Generally the total amount of surfactant is below 2% based on the weight of size and preferably it is less than 1%, usually less than 0.5%. Best results are usually obtained in the absence of surfactant.

If surfactant is present, it is usually selected from nonionic and anionic surfactants. Accordingly the sizing dispersions of the invention are usually anionic.

Traditionally, it is normally considered to be necessary, for internal sizing, to apply the size in combination with a cationic polyelectrolyte, for instance to improve substantivity onto the fibres when the size is being used as an internal size. However in the invention this is unnecessary and indeed it can be undesirable. Preferably therefore the dispersion is also substantially free of cationic polyelectrolyte, such as cationic starch or a synthetic cationic polymer. Generally therefore the amount of cationic polyelectrolyte is zero although trivial, non-interfering amounts, can be incorporated and, indeed, may be present in small quantities due to recycling loops at the mill. However such materials are best avoided.

As a generality, if emulsifying or other additives for the reactive size are present in the dispersion, their amount should be insufficient to make an emulsion of the same reactive size in the same water in the absence of the microparticulate material and which is stable, in the sense that it is stable for several hours. Further, the amount should be insufficient to make such an emulsion which is semi-stable, i.e., such that it breaks even within five minutes of initial manufacture.

By saying that we disperse neat liquid reactive size with the water and anionic particulate material we mean that we disperse the size while it is in liquid, unemulsified, form and is substantially pure, i.e. it does not contain large amounts of surfactant, water or other diluent but is, instead, generally the substantially pure material as initially manufactured and which, prior to the invention, is normally emulsified into water utilising emulsifying surfactant. If any diluent or other additive is present during manufacture of the dispersion, it is preferably one which does not significantly detract from the properties of the dispersion.

The process involves dispersing the reactive size as a neat liquid into a dispersion of anionic microparticulate material in water. This dispersion of microparticulate material in water is usually pre-formed, and thus the preferred method of the invention involves forming a dispersion of the microparticulate material in water, for instance by stirring the material into water, and then dispersing the reactive size into the resultant dispersion. However the invention also includes processes in which the dispersion of microparticulate material in water is formed at substantially the same time as the reactive size is dispersed into that dispersion. Thus, for instance, the microparticulate material, the reactive size and the water may be supplied separately to a dispersion apparatus so as to form, substantially simultaneously, the dispersion of microparticulate material in water and the dispersion of the reactive size in that. The invention does not include processes in which the size is first formed as a stable dispersion in water since the invention relies primarily on the microparticulate material to provide dispersion stability. Naturally it is possible to combine the neat reactive size and water in a single feed to a dispersing apparatus into which the anionic microparticulate material is introduced since the water and the size will not then form a dispersion (in the absence of the microparticulate material) but instead the reactive size will only disperse into the water in the presence of the microparticulate material. However this is generally inconvenient and it is normally better to predisperse the microparticulate material and then disperse the reactive size into it.

An advantage of the invention is that it is not necessary to apply as much homogenisation energy as is normally required for making a dispersion of reactive size in water using traditional techniques. Thus homogenisation is not required and, instead, is usually sufficient to apply mixing. Generally vigorous mixing, such as by a high shear mixer, for a reasonably short period (for instance less than 10 minutes and often less than 5 or even 2 minutes) is sufficient in order to obtain a satisfactory dispersion.

The amount of microparticulate material in the final dispersion is generally in the range 0.03 to 10% by weight of the dispersion, often 0.5 to 2% or 3%. Although it is satisfactory to add the size to a microparticulate dispersion having the desired final content of microparticulate material, better results seem to be obtained by adding the size to a dispersion having a higher concentration of microparticulate material than is finally desired and then diluting the resultant dispersion. For instance typically the size is mixed into a dispersion of at least 0.5%, typically up to 5%, microparticulate material and this dispersion is then diluted by 2 to 20 fold, often around 10 fold, to the desired solids content.

The water which is used in the dispersion is 0 preferably relatively "soft" since it is easier to obtain satisfactory sizing dispersions by the invention in the absence or substantial absence of emulsifier when the water is soft than when it is hard. Thus when the sizing dispersion is being made in mill process water which contains interfering substances, it may be necessary to use more emulsifying surfactant than when other water is used for make-up of the dispersion.

The water which is to be used can be subjected to ion exchange softening prior to use, but it is particularly preferred to include a sequestering agent in the water that is used for forming the dispersion of size and microparticulate material, preferably in the water which is used for forming the dispersion of microparticulate material and into which the reactive size is then added. The sequestering agent, alternatively known as a chelating agent, presumably interacts with hardness salts and, especially, polyvalent metal ions in the water. The sequestering agent is preferably an aminocarboxylic acid sequestrant such as ethylene diamine tetracetic acid or nitrilo acetic acid, but alternatively it can be any of the conventional phosphonic acid, hydroxy carboxylic acid or polycarboxylic acid sequestering agents which are known to be suitable for sequestering divalent and trivalent metal ions such as calcium, magnesium, iron and aluminium.

The amount of size will be selected having regard to the quality of the paper and the extent of sizing which is required. Usually the amount is 0.1 to 10 parts, often 0.3 to 3 parts per part by dry weight of anionic particulate material. Often the amount of size is at least 1.1 parts per part of the anionic material. The optimum amount of each, to obtain a satisfactorily stable sizing dispersion, can be found by routine experimentation. Typically the dispersion contains 0.05 to 2%, generally 0.07 to 0.3 or 0.5%, by weight of each of the size and the anionic microparticulate material.

The anionic particulate material which is used in the invention for forming the dispersion (and optionally also as microparticulate retention aid) can be selected from those inorganic and organic microparticulate materials which are suitable for use as microparticulate retention materials. It must be anionic and usually has a maximum dimension of below 3 $\mu$m, usually below 1 $\mu$m, in at least 90% by weight of the particles.

The preferred microparticulate materials for use in the invention are swelling clays. Thus, preferably the microparticulate material is a montmorillonite or smectite swelling clay. Generally it is a swelling clay of the type which is normally referred to colloquially as bentonite. Thus the microparticulate material useful for incorporation in the size dispersions of the invention can be one of the bentonite or other swelling clays conventionally used in paper making, for instance in the Hydrocol (trade name) microparticulate retention paper making process as described in EP-A-235,893 and EP-A-335,575. Such materials, in use, may separate into platelets or other structures having a maximum dimension of less than 1 $\mu$m, for instance about or less than 0.5 $\mu$m. The minimum dimension can be as low as 0.001 $\mu$m (1 nm) or less.

The swelling clay is preferably activated before use, in conventional manner, so as to replace some or all of the calcium, magnesium or other polyvalent metal ions which are exposed with sodium, potassium or other appropriate ions. Thus the preferred microparticulate material for use in the invention is activated bentonite of the type which is conventionally used in the Hydrocol and other paper making processes.

Instead of using a swelling clay, a microparticulate synthetic silica compound can be used. The preferred materials of this type are the polysilicic acid microgels, polysilicate microgels and polyaluminosilicate microgels as described in U.S. Pat. No. 4,927,498, 4,954,220, 5,176,891 or 5,279,807 and the use of which in paper making is commercialised under the trade name Particol by Dupont and Allied Colloids. The microgels typically have a surface area of 1200 to 1700 $m^2/g$ or more.

Instead of using these microgels, it is possible to use silica sols in which the silica particles typically exhibit a surface area in the range 200 to 800 $m^2/g$. Processes using silica sols as the microparticulate retention aid are described in U.S. Pat. No. 4,388,150 and WO86/05826 and are commercialised under the trade name Composil, and other processes using silica sols are described in EP 308,752 and are commercialised under the trade name Positek.

Although it is preferred to use an inorganic microparticulate material, especially a swelling clay or a siliceous material having a surface area of 200 to 1700 $m^2/g$, or more, organic microparticulate polymeric materials are also of potential use as the microparticulate material, for instance the materials described in U.S. Pat. No. 5,167,766 and 5,274,055 and used in the microparticulate retention process commercialised under the trade name Polyflex. The organic polymer particles may have a size below 1 $\mu$m, often below 0.5 $\mu$m average size.

The dispersion can be used for internal sizing, in which event it is optional whether the paper is given external sizing and, if it is, whether this is by a reactive size or an unreactive size.

When the dispersion is being used for internal sizing, the sizing dispersion which is added to the thin stock is usually the material which is formed by the defined process and thus is usually substantially free of cationic polyelectrolyte, surfactant or other additives, all as described above.

When the sizing dispersion is to be used for external sizing, the paper is often also internally sized, and it is optional whether the internal sizing is with a reactive size or an unreactive size. The sizing dispersion may have other components blended into before being used as an external sizing dispersion, for instance viscosity modifier, coating aids, binders and other materials which are conventional for the particular coating operation in which the dispersion is being used. Naturally these materials should be chosen so as to avoid destabilising the dispersion.

When the sizing dispersion is being used as an internal size, it can be incorporated into the thin stock at any convenient place and so could be incorporated into the thickstock which is then diluted. Generally it is added to the thinstock.

Preferably, the internally sized paper is made by a microparticulate retention process in which the dispersion provides part or all of the microparticulate retention material. Microparticulate retention processes comprise, as is well known, incorporating a polymeric retention aid in the thin stock and then mixing microparticulate retention material into the thin stock, generally after shearing sufficient to degrade flocs formed by the addition of the retention aid. Thus the size dispersion can be used in any of the microparticulate retention processes mentioned above or described in the patents given above.

Accordingly, a preferred process according to the invention is for making internally sized paper by a microparticulate retention process and comprises incorporating a polymeric retention aid in the cellulosic thin stock and then mixing the aqueous dispersion of reactive size and anionic microparticulate material into the suspension whereby that microparticulate material acts as microparticulate retention material, and then draining the suspension.

In particular, a preferred process of the invention for making sized paper from a cellulosic suspension utilises a microparticulate retention system comprising a polymeric retention aid and a microparticulate anionic material, and the process comprises providing a cellulosic suspension containing the polymeric retention aid, then mixing into the suspension a dispersion which is in make-up water and which contains the microparticulate anionic material and liquid water-insoluble reactive size, draining the suspension to form a sheet and drying the sheet, and in this process the dispersion in water contains the microparticulate material and the reactive size and is substantially free of emulsifying additives for the reactive size.

In such processes the dispersion may provide all the microparticulate material that is required, or additional microparticulate retention material may be added simultaneously or sequentially.

In preferred processes, the polymeric retention aid is added to the thin stock, the thin stock is then subjected to vigorous turbulence or high shear mixing and the dispersion and optionally other anionic microparticulate material is then added, usually after the last point of high shear, e.g., just before or at the head box. Although the process can be added using a single addition of polymeric retention aid, often two or more different polymers are added before the microparticulate material. For instance a cationic coagulant may be added first followed by a polymeric retention aid. The coagulant can be inorganic such as alum or other polyvalent metal inorganic coagulant, or it can be a low molecular weight, highly charged, cationic polymer.

In these processes, the retention aid is often cationic but can be anionic or non-ionic (and can be amphoteric).

If a separate microparticulate addition is being made in the process, the microparticulate material used for that may be the same as or different from the microparticulate material in the dispersion. Usually it is the same.

In these embodiments of the invention, there is therefore the significant advantage that the same addition is used both for providing internal sizing and for providing microparticulate retention. Further the microparticulate retention can be improved as a result of the presence of the size in some instances, and the ability to form the sizing dispersion in the substantial absence of emulsifier means that improved sizing performance can be obtained.

The sizing dispersions of the invention can be incorporated into the thin stock (or thick stock) in a wide variety of other paper making processes, i.e., processes that rely upon other retention systems.

For instance it can be added before a polymeric retention aid. Thus in other preferred processes of the invention the sizing dispersion is added to the thin stock (or the thick stock) and polymeric retention aid (often cationic) is subsequently added, for instance at or after the last point of high shear. Thus the sizing dispersion may be added before the centriscreen and the retention aid after the centriscreen, for instance on the way to the head box or at the head box.

In other processes, the dispersion can be added in place of the known use of bentonite or other microparticulate material. For instance the sizing dispersion can be added as replacement for part or all of the bentonite or other microparticulate material which is used as a pre-treatment for a thin stock or thick stock to which a substantially non-ionic polymeric retention aid or a cationic polymeric retention aid or an anionic polymeric retention aid is then added. This is of particular value when the stock is relatively dirty and the polymer is preferably of low ionicity, e.g., 0–10% by weight ionic monomer and 90 to 100% non-ionic monomer although higher cationic (or anionic) polymers can be used.

In all the previously described processes of the invention which involves the use of a retention aid, this material may be cationic starch but is preferably a synthetic high molecular polymer, typically having intrinsic viscosity above 4 dl/g. IV values herein are measured by suspended level viscometer at 20° C. in 1N sodium chloride buffered to pH 7. The IV is generally above 6 or 8 dl/g. When the polymer is cationic the IV is typically in the range 8 to 18 dl/g but when the polymer is non-ionic or anionic the IV is typically in the range 10 to 30 dl/g.

When the polymeric retention aid is substantially non-ionic, it may be of polyethylene oxide, but usually the retention aid is a polymer formed from ethylenically unsaturated monomers.

The polymeric retention aid is usually a substantially water soluble polymer formed by polymerisation of a water soluble ethylenically unsaturated monomer or monomer blend. The polymer may be anionic, non-ionic, cationic (including amphoteric), and will be chosen in accordance with conventional criteria.

Suitable non-ionic monomers include acrylamide. Suitable cationic monomers include diallyl dimethyl ammonium chloride and dialkylaminoalkyl (meth) -acrylates and -acrylamides (generally as quaternary ammonium or acid addition salts). Dimethylaminoethyl acrylate or methacrylate quaternary ammonium salt is often particularly preferred. Suitable anionic monomers include acrylic acid, methacrylic acid, acrylamido-methyl propane sulphonic acid and other carboxylic and sulphonic monomers.

Preferred anionic and cationic polymers are generally copolymers of 3 to 70 (often 5 to 50) weight percent ionic monomer and 97 to. 30 weight percent acrylamide or other non-ionic monomer.

High molecular weight polymers may be branched or slightly cross linked, for instance as decribed in EP 202,780.

When the process involves the use of a lower molecular weight, high charge density, polymer, this is usually a homopolymer of recurring cationic groups or a copolymer of at least 80% by weight cationic monomer and 0 to 20% by weight acrylamide or other non-ionic monomer. The cationic groups can be derived from any of the cationic monomers mentioned above. Alternatively the low molecular weight cationic polymer can be a condensation polymer such as a dicyandiamide polymer, a polyamine or a polyethylene imine. Inorganic coagulants (such as alum) can be used.

The sizing dispersions of the invention can also be used in processes in which the retention system comprises a phenol sulphone resin followed by polyethylene oxide. In these processes the sizing dispersion may be added at any stage in the process, and thus it may be added before or after the addition of the polyethylene oxide, but usually after the phenol sulphone resin. Suitable processes of this type are described in EP 693,146.

Other suitable paper making processes to which the invention can be applied are described in, for instance EP 235,893, U.S Pat. No. 4,927,498, U.S. Pat. No. 4,954,220, U.S. Pat. No. 5,176,891, U.S. Pat. No. 5,279,807, U.S. Pat. No. 5,167,766, U.S. Pat. No. 5,274,055 and EP 608,986 (including the patents mentioned therein).

The cellulosic suspension can be any suspension suitable for making sized paper. It can include recycled paper. It can be unfilled or filled and so may contain any of the conventional fillers. The invention is of particular value when the suspension contains at least 10% filler, for instance up to 50%.

The preparation of the suspension and the details of the paper-making process may be conventional except for the incorporation of the internal and/or external size in the form of the described dispersions. As indicated in the aforementioned patent specifications, some of the described processes are of particular value when the suspension is dirty, for instance as a result of prolonged recycling of the white water and/or the use of at least 25% mechanical or semi-mechanical pulp and/or deinked pulp.

The amount of retention polymer which is used will be selected from within conventional dosages and is generally in the range 0.01 to 0.5%, often around 0.03 to 0.1% based on the dry weight of paper. The amount of microparticulate material, when the retention process is a microparticulate retention process, is usually in the range 0.03 to 3% based on the dry weight of paper.

Thus, in preferred processes, at least 100 grams polymer and at least 300 grams bentonite or other microparticulate material are added per ton dry weight of paper.

When the invention is applied to the production of externally sized paper, the dispersion can be applied as a sizing composition to preformed paper. Thus paper can be made and wound up in the conventional manner and it can then be coated with the sizing dispersion of the invention, optionally containing other additives.

The invention also includes processes in which the external sizing is part of the overall paper making process, in which event the sized paper is made by a process comprising incorporating a polymeric retention aid into a cellulosic thin stock, draining the thin stock to form a sheet, drying the sheet, applying the said aqueous dispersion to the dried sheet, and redrying the sheet.

Accordingly, the size dispersion can be added in conventional manner at the conventional position in paper manufacture. In practice the paper is usually made on a paper making machine in which the suspension is fed on to the screen by a head box, dewatered pressed and passed through driers and then to a size press. Thus the paper making machine generally includes a size press and the dispersion is preferably applied at the size press with the excess of dispersion being recovered and recycled. Thus the invention includes processes in which excess of the dispersion is applied warm, for instance at a temperature above 40° C., to the sheet and excess dispersion is recovered and recycled.

Since the normal manufacturing process is conducted continously with recycling of excess sizing composition, it follows that the sizing composition is maintained at an elevated temperature for prolonged periods. This temperature is usually at least 50° C. and can be up to 70 to 80° C., often around 60° C. These conditions have, prior to the present invention, tended to increase hydrolysis of anhydride sizes with the consequential formation of stickies, but in the invention this undesirable formation of stickies is reduced or avoided. Thus, for the first time, it is possible to use an ASA or anhydride size in the size press without significant formation of stickies and without the need for other modifications of the size press conditions.

The external size composition can be applied to a wet sheet which is then dried but the sheet is normally fully or partially dry prior to the application of the size dispersion of the invention. Thus, when the external sizing is conducted during manufacture of paper on a paper machine, the sheet is usually dried below, to or towards ambient moisture content before the application of the size dispersion of the invention for surface sizing. Typically the process comprises draining the thin stock through the screen, pressing, drying wholly or partially, applying the dispersion and then redrying.

When the size dispersion of the invention is being used for external sizing, the paper will usually have been internally sized by the incorporation of a reactive or unreactive size in the thin stock. Thus unreactive or other size may be incorporated in the thin stock (including optionally in the thick stock from which the thin stock is formed) in conventional manner or the internal sizing may have been conducted in accordance with the invention.

The paper which is to be externally sized may have been formed in any conventional manner. It is therefore normally made using a retention system. Thus the overall process generally comprises incorporating a polymeric retention aid into the cellulosic thin stock, draining the thin stock to form the sheet, drying the sheet, applying the aqueous dispersion to the sheet and redrying the sheet. The polymeric retention aid may be the only material which is added to promote retention or a plurality of materials may be used as the retention system. For instance the retention system may be a microparticulate system, as described above. If so, the microparticulate retention material which is utilised may be the same as or different from the microparticulate material which is present in the dispersion which is applied to the sheet. Usually it is the same. Thus, preferably, bentonite or other swelling clay is used as part of the microparticulate retention system and as the microparticulate material for the external sizing dispersion.

Instead of using a microparticulate retention system, the system for making the paper which is to be externally sized may consist of a single polymeric retention polymer or a multiple dose system comprising counterionic polymers. Thus the process may comprise adding a cationic polymeric retention aid followed by an anionic polymeric retention aid or other anionic organic polymer. If desired the retention process may comprise a pre-treatment, for instance with bentonite or other microparticulate material or a low molecular weight cationic polymer or inorganic coagulant. Any of these processes may also be utilised in the internal sizing processes of the invention, for instance as indicated above.

The amount of ASA or other size in the sizing dispersion of the invention which is used for external sizing is generally in the same ranges as discussed above for internal sizing, typically 0.05 to 5% size and 0.05 to 10% particulate material, based on the total weight of the composition. The total dry coat weight provided by the surface sizing, i.e., the dry weight of size and particulate material and any other material which is included is generally in the range 0.07 $g/m^2$ to 65 $g/m^2$.

Although it is generally preferred, for internally sized systems, for the dispersion to be free of polyelectrolyte or other additive, the preferred external sizing compositions of the invention may contain conventional sizing components, and in particular conventional sizing binder. Thus, although the sizing dispersion of the invention is generally made in the presence of little or no surfactant, binder such as starch or other suitable polymer can be included. The starch may be gelatinised and may be unmodified or modified, for instance cationic starch. The dry weight of starch to reactive size is generally in the range 5:1 to 40:1, i.e., corresponding to the general proportions of starch and size conventionally applied when sizing at the size press. The optimum amount will depend upon other conditions, for instance the extent (if any) to which the sheet is already internally sized. The amount of starch or other binder which is applied in the external sizing coating is usually in the range 0 to 40 $g/m^2$.

When binder, viscosifier or other additives are to be included, they are usually mixed into the sizing dispersion of the invention after it has been made in the substantial absence of additives, as described above.

It seems that the drying which is applied after the internal or external sizing may contribute to the sizing success of the invention, perhaps as a result of migration of the size away from microparticulate material with which it is associated in the dispersion and on to the adjacent paper fibres. Drying can be conducted at conventional temperatures.

Advantages of the use of the sizing dispersions in external sizing involve the ability to externally size with ASA in processes where this would previously have been contraindicated because of excessive instability of the ASA size. Other advantages arise from the particular sizing benefits that are obtained (for instance in the composite black sizing determination for ink jet printing), and the benefit of having bentonite or other microparticulate coating in the external size coating. This gives desirable properties to the coating and, by the invention, it is possible to obtain both this and the benefits of incorporating the ASA or other liquid size.

For optimum results it seems to be desirable that the microparticulate material should interact closely with the exposed surfaces of size particles that are formed in the dispersion. For instance photographic examination of preferred compositions of the invention (using an anhydride size and bentonite or other swelling clay) made in the presence of soft water shows that many or substantially all of the surfaces of the size particles are covered by and apparently associated with platelets of the swelling clay. However in compositions which are less satisfactory (such as those which are only marginally stable and have been made in the presence of hard water and with inadequate emulsifier to compensate for the hardness) there are significant exposed surfaces of size particles, apparently without association between these exposed surfaces and the microparticulate material.

Whatever the mechanism, we find that there is close interaction between the size and the microparticulate material with the result that simple extraction of the dispersion with an organic solvent may result in extraction of none, or at most only a small proportion, of the size from the dispersion.

The preferred microparticulate materials are those which, in the processes of the invention, can be shown under photographic (by optical microscope) examination to show close association between the microparticulate material and the size. It is unclear whether this association is due to ionic interaction (perhaps with partially hydrolysed groups at the surfaces of the size particles) or whether it is due to some other physical interaction.

The following are examples.

EXAMPLE 1

Paper was made in accordance with the Hydrocol process as described in EP-A-235,893 by mixing an appropriate amount (usually in the range 300 to 800 g/t) water soluble cationic polymeric retention aid having IV above 6 dl/g followed by shear mixing in the normal paper-making apparatus followed by the addition of an aqueous dispersion of activated bentonite. The dry weight of paper was around 165 g/m$^2$.

ASA size was emulsified in hard water in the presence of 5% (based on the size) emulsifier to make a stable emulsion. This was then added to the bentonite dispersion at a dose of 2 kg/t (based on final paper). When the make-up water was very hard, the Cobb value of the final paper was 35 but when the make-up water was soft the Cobb value was 30.

When the process was repeated using neat size containing 1% surfactant homogenised direct into the bentonite suspension, the corresponding Cobb values were 30 and 27. It was not possible to form a stable emulsion from the ASA size containing this amount of emulsifier in the absence of the bentonite, either in soft water or hard water. The reduced Cobb values show the benefit of performing the process of the invention either in hard water or soft water with less emulsifier than is required to form a stable emulsion of the size in water.

When that process was repeated using ASA size in the total absence of surfactant, it was difficult to obtain an adequately stable dispersion of the microparticulate material and size in hard water, but in soft water a stable dispersion was formed and the Cobb value of the final paper was 26. This demonstrates the further advantage that is obtained by performing the process in the absence of emulsifying surfactant.

This demonstrates that, although a satisfactory dispersion can be made in the presence of 5% emulsifier, best results are obtained with low or zero amounts of surfactant.

EXAMPLE 2

0.65 parts of neat ASA (free of emulsifier or other additives) is mixed into a dispersion of 1 part activated bentonite in 99 parts water. When the water of the bentonite dispersion is hard, the resultant dispersion can be seen to have an oily tendency. When the water of the bentonite dispersion is soft, the resultant dispersion appears less oily. When 0.2 parts EDTA sodium salt is included in the water of the bentonite dispersion before dispersing the bentonite into, the resultant dispersion containing the ASA size appears very uniform and stable and gives improved sizing performance, both as an internal size or an external size.

In each of these tests the mixing is by means of a few seconds homogenisation using a Silverson mixer.

EXAMPLE 3

This is an example of a process similar to Example 1 except that the dispersion of the invention was made using ASA and 1% surfactant homogenised direct into a BMA colloidal silica aqueous dispersion. The Cobb values were as follows.

TABLE 1

| ASA dose kg/T | 2 | 4 | 6 | 8 | 12 |
|---|---|---|---|---|---|
| Cobb 60 secs (gsm) | 205 | 185 | 150 | 120 | 50 |

EXAMPLE 4

The process of Example 1 was repeated using neat ASA emulsified into a bentonite slurry at 4%. The results shown in Tables 2 were obtained.

TABLE 2

| ASA (kg/T) on top ply | ASA (kg/T) on total production | Cobb (gsm) off m/c | Cobb (gsm) off winder |
|---|---|---|---|
| 6.6 | 2.25 | 38 | 21 |
| 6.6 | 2.25 | 36 | 25 |
| 6.6 | 2.25 | 36 | 23 |
| 5.9 | 2.01 | 41 | 25 |
| 5.9 | 2.01 | 49 | 23 |
| 6.25 | 2.13 | 31 | 24 |

EXAMPLE 5

Neat ASA was dispersed into aqueous bentonite as in Example 1.

In process A the sizing dispersion was mixed into a waste-based cellulosic stock followed by a substantially non-ionic polymer after four inversions. In process B the polymeric retention aid was added, the system sheared, and the sizing dispersion was then added and mixed using four inversions. In process C the sizing dispersion was added and mixed with four inversions, but no retention aid was added.

The results are shown in Table 3.

TABLE 3

| ASA dosage (kg/T) | A - Cobb (gsm) | B - Cobb (gsm) | C - Cobb (gsm) |
|---|---|---|---|
| 2 | 124 | 73 | 171 |
| 4 | 70 | 31 | 150 |
| 8 | 31 | 19 | 95 |
| 12 | 24 | 14 | 26 |

EXAMPLE 6

In this, and the other bentonite examples, the bentonite slurry is subjected to shear using a silverson high shear mixer at 1200 rpm and the ASA is injected into this and the shear is continued for about 30 seconds.

The present example reproduced the process of example 1 using such dispersions formed with and without surfactant. In process C, the neat ASA was dispersed into the sizing composition in the absence of surfactant. In process D it was dispersed in the presence of 1% surfactant. The results are shown in Table 4.

TABLE 4

| ASA dosage (kg/T) | C - Cobb (gsm) | D - Cobb (gsm) |
|---|---|---|
| 0 | 187 | 187 |
| 1 | 126 | 156 |
| 2 | 114 | 124 |
| 4 | 35 | 109 |
| 8 | 19 | 21 |
| 12 | 16 | 16 |

EXAMPLE 7

In this process a 5% batch of bentonite dispersion was prepared using demineralised water and neat ASA was then shear mixed into that, as before, in the absence of emulsifier.

100 g/t of a phenol sulphone resin was mixed into the waste stock followed by 100 g/t polyethylene oxide followed by the ASA bentonite sizing dispersion.

The results are shown in Table 5.

TABLE 5

| ASA Dosage (kg/T) | Cobb (gsm) (60 seconds) |
|---|---|
| 6 | 34 |
| 8 | 27 |
| 10 | 24 |
| 12 | 22 |
| 15 | 19 |
| 20 | 21 |

EXAMPLE 8

100 mls of a 0.1% bentonite slurry in water was sheared using a Silverson emulsifier. After 5 seconds, 1 ml of neat ASA size was added and the resultant dispersion was sheared for a further 30 seconds.

This dispersion was coated on to liner board having an uncoated 60 second Cobb value of above 200 gsm using K bar no. 7. The treated liner board was dried on a rotary glazing drier at 60° C. for 4 minutes. The sheet was further dried in an oven at 110° C. for 30 minutes. After conditioning overnight, the 60 second Cobb value was 20. Ogsm.

EXAMPLE 9

Neat ASA was emuslified into water containing varying amounts of bentonite to form a sizing dispersion which was substantially immediately coated on to white printing/writing paper which had previously been internally sized. The coating with the ASA sizing dispersion of the invention resulted in external sizing to provide a substrate for ink jet printing. This was then subjected to a standard Hewlett Packard composite black assessment and the optical density minimum for each composition was recorded. The results are shown in Table 6.

TABLE 6

| Treatment | Optical Density Minimum |
|---|---|
| 1% ASA + 0% bentonite | 0.782 |
| 1% ASA + 0.5% bentonite | 0.816 |
| 1% ASA + 1.0% bentonite | 0.840 |
| 1% ASA + 2.0% bentonite | 0.914 |
| 1% ASA + 5.0% bentonite | 0.974 |

It will be appreciated in all these examples that the best sizing results are demonstrated by the lowest Cobb value and that, in Table 6, the best coating quality is indicated by the highest optical density value.

Thus the various examples demonstrate the sizing benefits of the invention and that these benefits are maximised when the surfactant is omitted.

What is claimed is:

1. A process of making a sizing dispersion of a reactive anhydride size which is liquid at room temperature, the process comprising dispersing the reactive anhydride size as a neat liquid into a dispersion of anionic microparticulate material in water in which the anionic microparticulate material is selected from swelling clays, silica, polysilicic acid, polysilicate microgel and polyaluminosilicate microgel, using less than 2% surfactant based on the weight of the size.

2. A process according to claim 1 in which the microparticulate material is bentonite.

3. A process according to claim 1 in which the water is soft.

4. A process according to claim 1 in which the dispersion is formed in the substantial absence of cationic materials.

5. A process according to claim 1 in which the dispersion is formed in the substantial absence of additive selected from cationic polyelectrolytes and surfactants.

6. A process according to claim 5 in which the dispersion is formed in the absence of cationic polyelectrolyte and in the absence of emulsifying surfactant or in the presence of not more than 2% (by weight based on the weight of reactive size) of surfactant.

7. A process according to claim 6 in which the dispersion is formed in the absence of surfactant or in the presence of not more than 1% of surfactant, and wherein the surfactant is selected from non-ionic and anionic surfactants.

8. A process according to claim 1 comprising dispersing the reactive size by stirring.

9. A process according to claim 1 in which the water is softened by ion exchange treatment and/or the dispersion is formed in the presence of sequestering agent.

10. A process of sizing paper comprising forming a sizing dispersion by a process according to claim 1 providing a sizing dispersion comprising a dispersion in water of a reactive size which is liquid at room temperature and anionic microparticulate material selected from swelling clays, silica, polysilicic acid, polysilicate microgel and polyaluminosilicate microgel which stabilizes the dispersion, and in which the dispersion is substantially free of cationic polyelectrolyte and contains not more than 2% surfactant and sizing the paper with the sizing dispersion.

11. A process according to claim 10 in which the paper is externally sized by coating the paper with the dispersion.

12. A process according to claim 11 in which additional viscosifying and/or coating components are included in the dispersion before coating the dispersion on to the paper.

13. A process according to claim 11 for making externally sized paper comprising incorporating a polymeric retention aid into a cellulosic thin stock, draining the thin stock to form a sheet, drying the sheet, applying the said aqueous dispersion to the sheet and redrying the sheet.

14. A process according to claim 10 wherein the dispersion contains not more than 1% surfactant.

15. A process according to claim 10 wherein the dispersion is free of surfactant.

16. A sizing dispersion comprising a dispersion in water of a reactive size which is liquid at room temperature and anionic microparticulate material selected from swelling clays, silica, polysilicic acid, polysilicate microgel and polyaluminosilicate microgel which stabilises the dispersion, and in which the dispersion is substantially free of cationic polyelectrolyte and is free of surfactant.

17. A process for internally sizing paper comprising incorporating the sizing dispersion according to claim 16 into a cellulosic thinstock suspension and then draining the suspension through a screen to form a sheet and drying the sheet.

18. A process according to claim 17 comprising incorporating a polymeric retention aid in the cellulosic thinstock and then mixing the aqueous dispersion of reactive size and anionic microparticulate material into the thinstock as a microparticulate retention material and then draining the suspension.

19. A process according to claim 18 in which the dispersion which is incorporated into the cellulosic thinstock has been made by a process in which the dispersion is formed in the substantial absence of additive selected from cationic polyelectrolytes and surfactants or is a dispersion comprising a dispersion in water of a reactive size which is liquid at room temperature and anionic microparticulate material which stabilises the dispersion, and in which the dispersion is substantially free of cationic polyelectrolyte and contains not more than 2% surfactant and is substantially free of additives selected from cationic polyelectrolytes and surfactants.

20. A process according to claim 19 wherein the dispersion contains not more than 1% surfactant.

21. A process according to claim 19 wherein the dispersion is free of surfactant.

22. A process for making sized paper form a cellulosic suspension utilising a microparticulate retention system comprising a polymeric retention aid and a microparticluate anionic material selected from swelling clays, silica, polysilicic acid, polysilicate microgel and polyaluminosilicate microgel, the process comprising providing a cellulosic suspension containing the polymeric retention aid, then mixing into the suspension a dispersion which is in water and which contains the microparticulate anionic material and the water insoluble reactive size, draining the suspension to form a sheet and drying the sheet, characterised in that the dispersion contains the microparticulate material and the reactive size and is substantially free of additives selected from cationic polyelectrolytes and surfactants.

23. A process according to claim 17 in which the dispersion is incorporated into the cellulosic suspension and polymeric retention aid is then added.

24. A process according to claim 17 in which a phenolsulphone resin is incorporated into the suspension followed by a polyethyleneoxide resin as a retention system and the dispersion is added to the suspension before or after the addition of polyethyleneoxide.

* * * * *